United States Patent [19]

Sedlmair et al.

[11] Patent Number: 4,600,213

[45] Date of Patent: Jul. 15, 1986

[54] SAFETY SKI-BINDING HAVING A SOLE PLATE

[75] Inventors: Gerhard Sedlmair, Farchant; Walter Knabel, Murnau, both of Fed. Rep. of Germany

[73] Assignee: Marker International Company, Salt Lake City, Utah

[21] Appl. No.: 726,118

[22] Filed: Apr. 23, 1985

[30] Foreign Application Priority Data

Apr. 24, 1984 [DE] Fed. Rep. of Germany ..... 3415272

[51] Int. Cl.[4] ..... A63C 9/081

[52] U.S. Cl. ..... 280/618; 280/636

[58] Field of Search ..... 280/618, 636, 620, 627, 280/623, 607

[56] References Cited

U.S. PATENT DOCUMENTS

| | | | |
|---|---|---|---|
| 1,593,937 | 7/1926 | Hall | 280/618 |
| 3,931,980 | 1/1976 | Marker | 280/618 |
| 4,185,852 | 1/1980 | Himmetsberger | 280/618 |
| 4,336,955 | 6/1982 | Schmidt | 280/618 |

*Primary Examiner*—John J. Love

*Assistant Examiner*—Joseph G. McCarthy

*Attorney, Agent, or Firm*—D. Peter Hochberg

[57] ABSTRACT

A safety ski-binding having force transmitting surfaces which are inclined at an angle which corresponds substantially to the angle of friction. The force component acting in the direction of release of the sole plate created by the additional load compensates for the friction, so that the release resistance is not influenced even for a heavy load from the ball of the skier's foot even for the purely rotary fall load. These inclined surfaces are preferably provided on a rearward tongue which is disposed between the base plate and a rearward guide rail, the rearward tongue comprising an upper surface in substance in the shape of a flat M whose upper tips are flattened to abut in the normal position supporting elements depending from the guide rail. A forward tongue and guide rail is similarly provided and both the forward and/or rearward tongues which are configured at their lower and upper surfaces, respectively, as a W or an M, for engaging two supporting elements on a ski structure cooperating with the respective tongues for compensating for friction on the binding.

11 Claims, 5 Drawing Figures

SAFETY SKI-BINDING HAVING A SOLE PLATE

BACKGROUND OF THE INVENTION

The present invention relates to safety ski-bindings, and in particular to safety ski-bindings for compensating for the effects of friction on the release characteristics of the binding.

Safety ski-bindings of this type are known in different designs and are disclosed for instance in German Offenlegungsschrift Nos. 2804986 and 3102010. Bindings of this type have the advantage over conventional safety ski-bindings that the ski-boot is not directly supported on the ski or on a sliding plate fixedly mounted to the ski, which avoids the situation in the latter bindings where for lateral loads on the ski-boot uncontrollable frictional resistances occur. Such frictional resistances have very varying magnitudes depending on the forward bend of the skier. For safety ski-bindings having a sole plate, the situation regarding the friction is more favorable because the location where the friction occurs is moved, inasmuch as the friction is independent of the material and the condition of the ski-boot sole. Bindings of this type are, however, by no means free of friction and the friction indeed varies also, because the pressure of the ball of the foot varies in magnitude depending on the position of the skier on the ski.

SUMMARY OF THE INVENTION

An object of the present invention is to provide an improved safety ski-binding.

It is another object of the present invention to provide a safety ski-binding having a sole plate in which the release force at which the latched binding is released remains for all practical purposes independent of the friction created by the pressure from the ball of the foot.

Still another object is to provide a binding which avoids releases which occur in response to external forces other than the release force setting of the binding, while assuring that release will occur when forces are applied to the binding which exceed the release value for which the binding is set.

In accordance with the preferred form of the present invention, the above objects are achieved by providing force transmitting surfaces which are inclined at an angle which, corresponds substantially to the angle of friction. The force component acting in the direction of release of the sole plate created by the additional load compensates for the friction, so that the release resistance is for all practical purposes not influenced even for a heavy load from the ball of the skier's foot even for the purely rotary fall load. These inclined surfaces are preferably provided on a rearward tongue which is disposed between the base plate and a rearward guide rail, the rearward tongue comprising an upper surface in substance in the shape of a flat M whose upper tips are flattened to abut in the normal position supporting elements depending from the guide rail. So as to achieve the advantages of the invention for loads from the ball of the foot and also for rearward loads, according to another aspect of the invention, there are provided forward and/or rearward tongues which are configured at their lower and upper surfaces, respectively, as a W and an M, for engaging two supporting elements on a ski structure cooperating with the respective tongues for compensating for friction on the binding.

BRIEF DESCRIPTION OF THE DRAWINGS

An embodiment of the invention will now be described by way of example and with reference to the accompanying drawings, in which.

DETAILED DESCRIPTION OF THE PREFERRED EMBODIMENT

Figure 1:
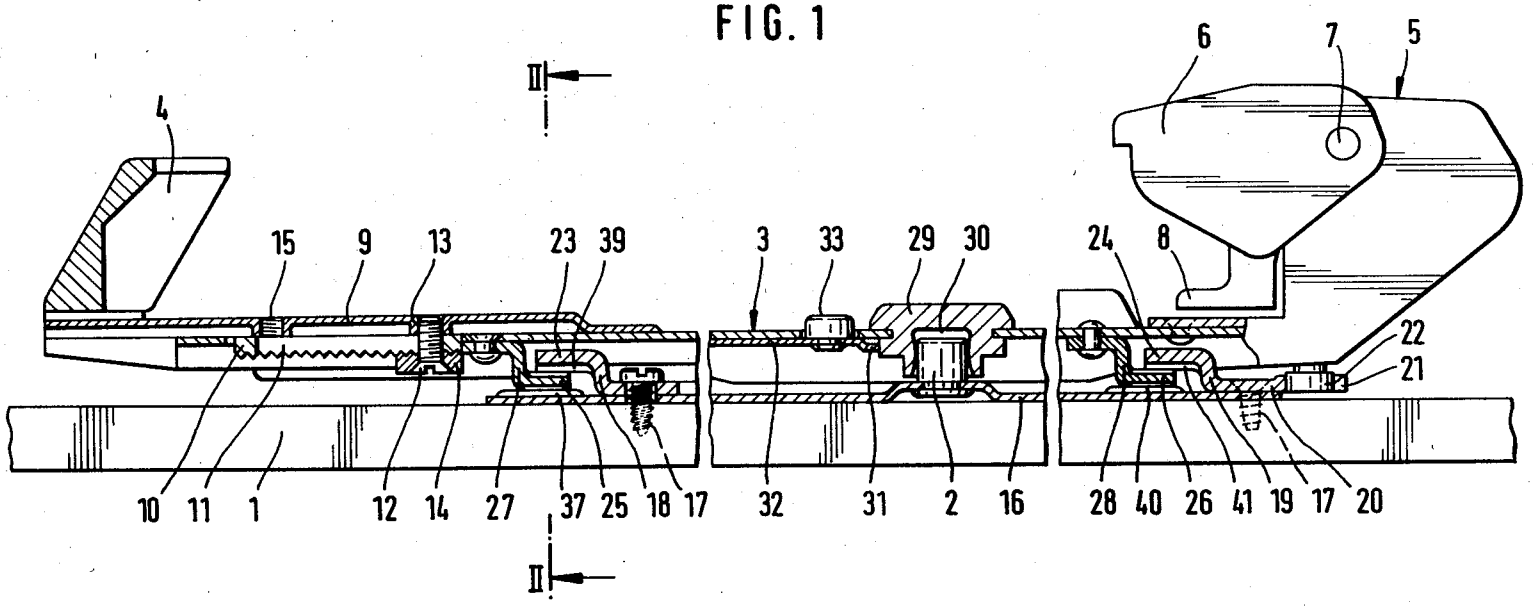
FIG. 1 is a centrally located longitudinal section of a safety ski-binding showing essential parts of the preferred embodiment of the invention.

A safety ski-binding according to the preferred embodiment of the invention comprises a sole plate 3 which is rotatably mounted by means of a perpendicular axis pin 2 on a ski 1. The sole plate 3 comprises at its front end a toe holder 4 and at its rear end a heel member 5. The heel member 5 comprises a sole holder 6 which is mounted for pivotal movement about a horizontal transverse axis 7. The sole holder 6 carries a closing pedal 8. The heel member 5, selected and shown here, is designed to provide for a release of the ski-boot either voluntarily or because of the occurrence of forces which would impair the skier's safety. The toe holder 4 is rigidly connected with a support member 9 which extends sideways beyond the sole plate 3. The support member 9 serves for the adaptation of the ski binding to ski-boots of different sizes and is, for this purpose, adjustably mounted at the free front end of the sole plate 3. For these reasons of adjustment, the sole plate 3 comprises a rack rail 10 and an elongated hole 11. A screw 12 extends through elongated hole 11 and is screwed in a threaded bore 13 of the support member 9. Screw 12 in turn supports a toothed plate 14, the teeth of which are normally in engagement with the teeth of the rack rail 10 so as to secure the support member 9 at the sole plate 3 with respect to any movement. So as to enlarge the range of adjustment of the support member 9 a second threaded bore 15 is provided in the support member 9 for the screw 12.

The axis pin 2 is riveted to a base plate 16. The base plate 16 is screwed to the ski 1 by means of screws 17. The base plate 16 further carries Z-shaped angles 18, 19, which are also held by screws 17. The angles 18 and 19 serve to hold the sole plate 3 down. A leg 20 of the angle 19 which rests upon the base plate 16 is, as is shown in FIG. 1, extended toward the right hand side and forms by means of a centrally located V-shaped recess 21, two cam curves which are symmetrically arranged with respect to the middle longitudinal plane. The cam curves are adapted for cooperation with a detent member such as a detent roller 22. The axis pin of roller 22 is mounted in the heel member 5 and is in a known matter spring biased such that the roller 22 has the tendency to gain its normal position at the bottom of the recess of the leg 20 and to hold the sole plate 3 in a position parallel to the ski 1.

Each of the legs of the angles 18 and 19 which are located distant from the ski form one guide rail 23 and 24, respectively. Guide rails 23, 24 extend in the operational condition of the ski-binding beyond a guide tongue 25 and 26, respectively. Guide tongues 25 and 26, respectively, are formed by the legs of Z-shaped angles 27 and 28. The angles 27 and 28 are fixedly mounted to the sole plate 3, e.g. by means of riveting.

It should be noted that the guide tongues 25 and 26 could also be designed to be integral with the sole plate 3, i.e. from a single piece with the sole plate. Sole plate 3 includes a mounting member 29 as a support member on the axis pin 2. The mounting member 29 is provided with a receiving bore 30 of a slightly convex shape in cross section. The mounting member 29 is held on the sole plate in a manner similar to a bayonette mounting and is secured against rotation by the free end 31 of a leaf spring 32. The leaf spring 32 is, for example, riveted to the sole plate 3 and carries an actuating button 33 which extends upwardly through and above a hole in the sole plate 3. When the button is depressed, the mounting member 29 is released and the bayonette closing means is opened, and the subsequent removal of the sole plate 3 from the ski 1 is thus made possible.

Figure 2:
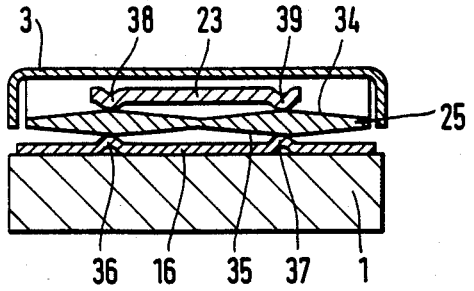
FIG. 2 is a cross sectional along line II—II in FIG. 1.

In accordance with the preferred embodiment of the present invention, the guide tongues 25 and 26 are designed as is shown in FIG. 2. While FIG. 2 shows only guide tongue 25, it should be noted that the guide tongue 26 is of the same design. The upper surface 34 of the guide tongue is in the form of a flat M, while the bottom surface 35 has the form of a flat W. The two upper tips and two lower tips of the M and W, respectively, are flattened. FIG. 2 shows the normal position, and in this position the two bottom tips rest on supporting elements 36 and 37, respectively, while supporting elements 38, 39 are placed opposite to the two upper tips. The design of the guide tongues 25 and 26 respectively and consequently the arrangement of the supporting elements of a pair of supporting elements are placed symmetrically with respect to the longitudinal axis of the ski 1 and are spaced apart by a distance which corresponds to the elastic pivot area of the sole plate 3. The supporting elements 36 and 37 are formed by outwardly pressed portions of the base plate 16, and the supporting elements 38 and 39 are formed at the two ends of the guide rail 23.

As is shown in FIGS. 2 to 5, the sole plate has a portion in the shape of a reversed U which is parallel to a ski on which the binding is mountable. In accordance with the sectional line II—II in FIG. 1, FIGS. 2 to 5 disclose the guide rail 23 of the angle 18 and the guide tongue 25 of the angle 27. It should be noted, however, that the design and arrangement of the guide rail 24 and of the guide tongue 26 is substantially similar to what is shown in FIGS. 2 to 5. This is true also for the supporting elements 40 and 41 which are shown in FIG. 1 but are again designed similarly to the supporting elements 36, 37 and 38,39 shown in FIGS. 2 to 5.

Figure 3:
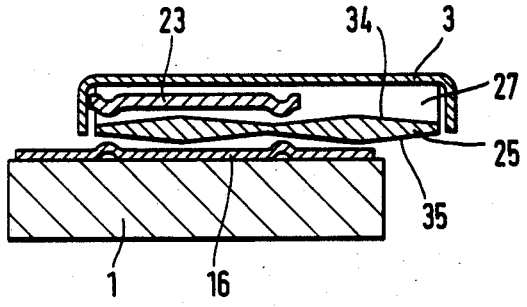
FIGS. 3 to 5 are representations similar to FIG. 2 showing different conditions of the load of the sole plate.

FIGS. 1 and 2 disclose the sole plate 3 in its normal position on the ski 1. The sole plate 3 can be pivoted out of this normal position and about axis pin 2 towards the two sides in a limited manner against the force of a spring which is located in the heel portion 5. At the end of this pivotal movement a safety release of the ski-boot held in the binding will be effected by known means which are not shown here because they are not the subject matter of the present invention. FIG. 3 shows the sole plate in a pivoted condition with a pure rotary load being applied. In this situation, the upper surface 34 and the bottom surface 35 of the guide tongue 25 are free with respect to the appropriate supporting elements 36 through 39. After the ski-boot is released or in case the rotary force subsides, the sole plate automatically returns to its normal position shown in FIG. 2.

Figure 4:
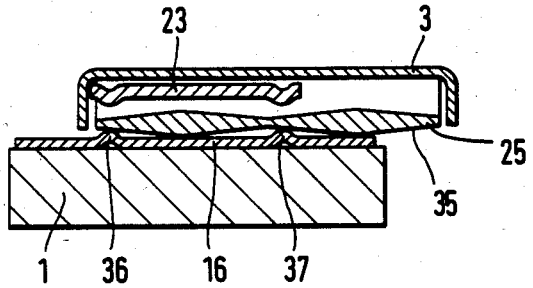

FIG. 4 discloses the different condition of load than in FIG. 3. FIG. 4 also shows a condition where in addition to the sideways load also a load directed downwardly is present. This force is taken up by the two supporting elements 36 and 37. Because the bottom surface 35 is shaped like a flat W, the additional load from the ball of the foot does not lead to a resistance which is higher than the predetermined resistance. This is so because the bottom surface 35 is inclined in accordance with the frictional angle and generates a component of force in the direction of release; this component of force compensates for the friction. As a consequence, the predetermined release resistance for the sideways load remains for practical purposes constant and not influenced by the additional loads from the ball of the skier's foot.

Figure 5:
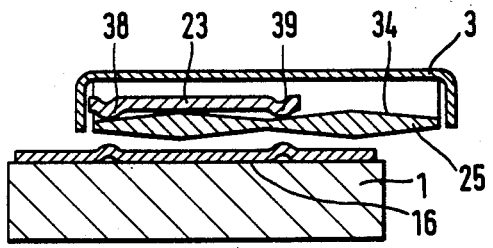

FIG. 5 shows in contrast to FIG. 4 a condition of load where an additional so-called rearward load occurs. In such a situation, the upper surface 34 of the guide tongue 25 abuts the supporting elements 38 and 39 of the guide rail 23. Inasmuch as the upper surface 34 has the shape of a flat M, the explanation given above applies here too, i.e. the sideways acting release resistance is maintained at least substantially constant.

Inasmuch as the sole plate 3 is for all practical purposes inelastic, an additional load from the ball of the foot will lead to a support or abutment of the rearward guide tongue 26 at the supporting elements of the guide rail 24. This condition corresponds for all practical purposes to the condition shown in FIG. 5. Conversely, an additional rearward load will lead to an abutment or support of the guide tongue 26 at the rearward supporting elements at the base plate 16. This condition corresponds therefore to the condition shown in FIG. 4.

The invention has been described in detail with particular emphasis on the preferred embodiment, but it should be understood that variations and modifications within the spirit and scope of the invention may occur to those skilled in the art to which the invention pertains.

We claim:

1. A safety ski-binding releasable from a latched condition in response to the occurrence of an external force exceeding a predetermined force setting of the binding, said binding comprising sole plate means mountable on a ski for pivotable movement about an axis perpendicular to the surface of the ski;

tongue means operatively associated with said sole plate means and with said base plate means, said tongue means having a lower surface with configuration of the letter W;

lower support means fixable on the ski opposite the W-shaped lower surface of said tongue means, said lower support means being engageable with the tips of said W in the absence of a sideways load on the binding; and said W-shaped lower surface being inclined to engage said lower support means upon the occurrence of a downward and sideways load to compensate for the effect of friction on said internal force.

2. The invention according to claim 1 and further including base plate means fixable on the ski, wherein said support means comprise support elements extending upwardly from said base plate means.

3. The invention according to claim 1 wherein said tongue means further includes an upper surface having the configuration of a flattened M, and wherein said binding further includes guide rail means fixably mountable on the ski; said tongue means being disposed between said guide rail means and said lower support means, and said guide rail means including upper support means engageable with the tips of said M in the absence of a sideways load on the binding; and said M-shaped upper surface being inclined to engage said upper support means upon the occurrence of an upward and sideways load to compensate for the effect of friction on said external force.

4. The invention according to claim 3 wherein said upper support means and said lower support means are opposite each other.

5. The invention according to claim 1 wherein said lower support means are disposed symmetrically about a longitudinal, vertical, central plane through the ski.

6. The invention according to claim 1 wherein said upper support means are disposed symmetrically about a longitudinal, vertical, central plane through the ski.

7. The invention according to claim 1 wherein said binding further includes a toe holder at a forward end of said sole plate means, and said tongue means is located adjacent said toe holder.

8. The invention according to claim 1 wherein said binding further includes a heel member at a rearward end of said sole plate means, and said tongue means is located adjacent said heel member.

9. A safety ski binding releasable from a latched condition in response to the occurrence of an external force exceeding a predetermined force setting of the binding, said binding comprising sole plate means mountable on a ski for pivotable movement about an axis perpendicular to the surface of the ski;

tongue means operatively associated with said sole plate means and with said base plate means, said tongue means having an upper surface with configuration of the letter M;

upper support means fixable on the ski opposite the M-shaped upper surface of said tongue means, said upper support means being engageable with the tips of said M in the absence of a sideways load on the binding; and said M-shaped upper surface being inclined to engage said upper support means upon the occurrence of an upward and sideways load to compensate for the effect of friction on said internal force.

10. The invention according to claim 9 wherein said binding further includes a toe holder at a forward end of said sole plate means, and said tongue means is located adjacent said toe holder.

11. The invention according to claim 9 wherein said binding further includes a heel member at a rearward end of said sole plate means, and said tongue means is located adjacent said heel member.

* * * * *